US007683794B2

(12) United States Patent
Contreras

(10) Patent No.: US 7,683,794 B2
(45) Date of Patent: Mar. 23, 2010

(54) CARBON MONOXIDE SAFETY SYSTEM FOR PREVENTING ENTRY INTO A DWELLING CONTAINING TOXIC GASES

(76) Inventor: David Contreras, 10101 SW. 136 St., Miami, FL (US) 33176

( * ) Notice: Subject to any disclaimer, the term of this patent is extended or adjusted under 35 U.S.C. 154(b) by 285 days.

(21) Appl. No.: 11/748,890

(22) Filed: May 15, 2007

(65) Prior Publication Data

US 2008/0284579 A1 Nov. 20, 2008

(51) Int. Cl.
*G08B 17/10* (2006.01)

(52) U.S. Cl. ..... 340/632; 340/539.14; 340/5.71

(58) Field of Classification Search ..... 340/632, 340/539.12, 539.14, 539.26, 5.71
See application file for complete search history.

(56) References Cited

U.S. PATENT DOCUMENTS

| | | | | |
|---|---|---|---|---|
| 3,609,732 | A | 9/1971 | Kasahara | |
| 3,733,595 | A | 5/1973 | Benedict | |
| 3,826,180 | A | 7/1974 | Hayashi | |
| 3,909,816 | A | 9/1975 | Teeters | |
| 3,997,837 | A | 12/1976 | Betz et al. | |
| 4,197,675 | A | 4/1980 | Kelly | |
| 4,360,801 | A | 11/1982 | Duhame | |
| 4,514,729 | A | 4/1985 | Szarka | |
| 4,567,557 | A | 1/1986 | Burns | |
| 4,665,385 | A | 5/1987 | Henderson | |
| 4,819,551 | A | 4/1989 | Vole | |
| 5,239,980 | A | 8/1993 | Hilt et al. | |
| 5,507,539 | A * | 4/1996 | Basinski | 292/92 |
| 5,576,739 | A | 11/1996 | Murphy | |
| 5,947,814 | A | 9/1999 | Czeck et al. | |
| 6,967,562 | B2 * | 11/2005 | Menard et al. | 340/5.64 |
| 7,417,553 | B2 * | 8/2008 | Young | 340/628 |
| 7,532,709 | B2 * | 5/2009 | Styers et al. | 379/37 |
| 2002/0111132 | A1 | 8/2002 | Meneely, Jr. | |
| 2003/0020619 | A1 | 1/2003 | Winters et al. | |
| 2003/0087600 | A1 | 5/2003 | Meneely, Jr. | |
| 2003/0090374 | A1 | 5/2003 | Quigley | |
| 2003/0128114 | A1 | 7/2003 | Quigley | |
| 2005/0212681 | A1 | 9/2005 | Dzurko et al. | |

* cited by examiner

*Primary Examiner*—Jeffery Hofsass
(74) *Attorney, Agent, or Firm*—McHale & Slavin, P.A.

(57) ABSTRACT

The instant invention provides a system for avoiding or reducing exposure to toxic gases. More specifically, the instant invention includes a base module having a first transceiver securable within a structure, and most preferably within the garage of a home. The base module is constructed and arranged to communicate with a remote module having a second transceiver to alert the user of a dangerous condition within the structure prior to entry thereto. In a most preferred embodiment, the remote module is also a garage door opener that can be carried by a person or within a vehicle. In operation, the remote module sends a signal to the base module. In response, the base transceiver checks the level of a toxic gas such as carbon monoxide within the dwelling, if the level is below a predetermined limit the base module sends a signal to the garage door opener to open the door, if the level of the gas is above the predetermined limit an alarm will be sent to the remote transceiver and the door will not be opened.

7 Claims, 3 Drawing Sheets

CARBON MONOXIDE SAFETY SYSTEM FOR PREVENTING ENTRY INTO A DWELLING CONTAINING TOXIC GASES

FIELD OF THE INVENTION

This invention relates to a device and system for warning an individual in a vehicle of excessive carbon monoxide levels within their dwelling prior to personal or vehicular entry thereto.

PRIOR ART BACKGROUND

In general, carbon monoxide (CO) is hazardous to a person's health. When breathed, carbon monoxide replaces oxygen in the bloodstream. Mild carbon monoxide poisoning results in flu-like symptoms, while more serious poisoning leads to difficulty in breathing and even death via suffocation.

Carbon monoxide poisoning is believed to be the leading cause of accidental poisoning deaths in the United States. On the average, approximately 5,000 deaths occur, and over 20,000 illnesses result each year from carbon monoxide poisoning.

Carbon monoxide is an invisible, odorless, colorless gas that is a by-product of the incomplete combustion of fossil fuels. This makes it difficult for an individual to recognize the presence of excessive carbon monoxide. In the home, heating and cooking equipment are common potential sources of carbon monoxide. Furnaces are another source of carbon monoxide. Furnaces may be installed at various areas within a home such as, the basement, the attic or within a closet. Any of theses installations could infiltrate the house with carbon monoxide in the event of a malfunction. A mechanical failure such as a fractured heat exchanger may force carbon monoxide through the duct-work of the house to create a toxic condition. Motor vehicles also produce carbon monoxide that can reach dangerous levels when left running in a closed or poorly ventilated garage. This carbon monoxide can infiltrate into a home from an attached garage that may reach toxic levels.

As a result, carbon monoxide detectors are well known in the art. Current carbon monoxide detectors typically monitor carbon monoxide levels in one of three processes. The first process is based on electrochemical technology that uses three platinum electrodes in an electrolyte solution that generate energy when they react with the carbon monoxide, thereby setting off an alarm. The second process uses metal oxide semiconductor technology that is heated every few minutes to react with carbon monoxide and determine levels of that gas. The third process uses bio-mimetic technology that is designed to mimic the hemoglobin response to carbon monoxide, which is to change to a darker color as the level of carbon monoxide increases.

These conventional detectors are generally provided with an internal audible alarm that sounds when the presence of carbon monoxide is detected, similar to common household fire and smoke detectors, with the intention of alerting occupants of a building to enable evacuation and/or take other corrective measures as appropriate.

However, such audible alarms are ineffective when the homeowners are away from the home, at work, running errands, vacation etc. The homeowner may unknowingly return to the home contaminated with CO. The audible alarms are generally muffled so that they cannot be heard from an automobile approaching the home or entering the garage.

There have been attempts in the art to improve the performance of carbon monoxide detectors by causing them to open garage doors, operate fans or turn off devices that are producing carbon monoxide. For example, Hayashi, U.S. Pat. No. 3,826,180, discloses a ventilation fan system with smoke detector speed control. The device includes an electronic circuit that is actuated when a detecting element detects the existence of any smoke or gas in an enclosed area while a fan is in a manually selected slow rotating mode of operation or in a stand-by stopped position. Upon detection of smoke or a gas such as carbon monoxide; the fan is automatically put into full rotation mode in order to expel the smoke or gas. The device expels the smoke or gas through a window that includes solenoid operated shutters that are also controlled by the device.

Kelly, U.S. Pat. No. 4,197,675, discloses a sensing system for use in a garage or other similar enclosure having an automatic door operator for automatically opening a garage door responsive to a lack of sufficient oxygen therein. The device includes a gas detector located within the enclosure responsive to actuate a detection relay which in turn will close a normally open detection switch. The closing of the detection switch causes operation of the door opener to allow oxygen to enter into the enclosure through the door opening.

Duhame, U.S. Pat. No. 4,360,801, discloses a home security and garage door operator system. The system includes a gas sensor for detecting the level of toxic gas in the garage. When the gas level exceeds a predetermined threshold the garage door is automatically opened.

Vole, U.S. Pat. No. 4,819,551 discloses a safety system for smoke and fumes. The system includes a detector unit for detecting fumes, including carbon monoxide. The device is located in a garage, and circuitry controlled thereby automatically opens the garage door, or operates an exhaust blower, or both upon detection of carbon monoxide.

Murphy, U.S. Pat. No. 5,576,739, discloses a carbon monoxide safety system. The system measures noxious gas concentration in an affected space and controls the device producing the noxious gas for decreasing the concentration of the gas in the affected space. The invention is particularly described in relation to measuring carbon monoxide concentration in an automobile garage and for controlling the garage door opener circuit to open the garage door in response to a preselected concentration of carbon monoxide. Also described in particular is a system for deactivating a furnace operating circuit to turn off the furnace in the event of excessive carbon monoxide concentration.

Czeck et al., U.S. Pat. No. 5,947,814, discloses a garage carbon monoxide venting system. The gas venting system includes an electrically operated exhaust fan used in an enclosed garage to expel unwanted gases, especially carbon monoxide, to outside the garage and away from an attached residence.

Meneely, Jr., U.S. Patent Publication Nos. 2002/0111132 and 2003/0087600 disclose a carbon monoxide ventilation system, comprising a carbon monoxide sensor, a fan, and a vent. The carbon monoxide sensor supplies power to the fan when a threshold level of carbon monoxide is detected. The fan includes a motor and a propeller which draws air into the fan unit, and expels the air through the vent.

Dazurko et al., U.S. Patent Publication No. 2005/0212681, discloses a garage monitoring system for use with an automatic garage door opening mechanism that includes a carbon monoxide detector configured to sense the presence of carbon monoxide within the garage and generate an audible alarm when carbon monoxide reaches a predetermined level in the garage.

Winters et al., U.S. Patent Publication No. 2003/0020619, discloses a proactive carbon monoxide protection system that includes a carbon monoxide detector connected to a control module adapted to turn off the source of carbon monoxide, sound a central alarm, and alert an off-site monitoring station upon detection of carbon monoxide by the detector.

While these devices may be effective in some instances for reducing CO in a garage or home, they may also create additional problems for the home owner. For example, opening the garage door while the owner of the home is away breaches the security of the home by allowing easy entry to at least the garage and possibly the home itself. Automatic garage door operation may additionally trigger an alarm system. Absent a special signal to the alarm company, indicating high CO level, the police may be forced to unknowingly enter the home filled with dangerously high levels of CO in search of a burglar. Still yet, turning off an appliance such as a furnace without supervision can have devastating consequences to the home owner should he/she be away from the home. The pipes as well as other portions of the home could be frozen and permanently damaged causing extensive damage to the home.

Often high CO levels are associated with an automobile. Vehicles are often left running in the garage of a home for various reasons. Warming up the vehicle, talking on a cell phone, and going back into the home to retrieve a forgotten item are just a few of the reasons why an automobile may be left running in the garage. In the case of a town-home or apartment, a failed appliance or running vehicle may cause high CO levels in the adjacent dwellings.

Thus, there is a need for a new and improved monitoring and protection system that addresses the drawbacks and disadvantages of such prior CO monitoring devices. The system should monitor CO levels within the home and/or garage and upon the attempted opening of the garage door for entry to the home an internal monitor having a first transceiver should send a signal to a remote transceiver in the vehicle to indicate whether or not the building is safe to enter. The device may include one mode for when people are in the home and a second mode for when people are away from the home. The first mode should provide an audible alarm in addition to automatic opening of the garage door to vent gasses if the gas levels are high in the garage. In the second mode, a base monitor should send a signal to the remote transceiver to notify the person of a problem prior to entry into the dwelling. In addition the remote transceiver should continuously monitor the air conditions within the vehicle itself to alert the driver and/or passengers in the event the air becomes unsafe.

SUMMARY OF THE PRESENT INVENTION

The instant invention provides a system for avoiding or reducing exposure to toxic gases. More specifically, the instant invention includes a base transceiver securable within a structure and most preferably within the garage of a home. The base transceiver is constructed and arranged to communicate with a remote transceiver to alert the user of a dangerous condition within the structure prior to entry thereto. In a most preferred embodiment, the remote transceiver is also a garage door opener that can be carried by a person or within a vehicle. In operation, the remote transceiver sends a signal to the base transceiver. In response, the base transceiver checks the level of a toxic gas such as carbon monoxide within the dwelling; if the level is below a predetermined limit the door will open, if the level of the gas is above the predetermined limit an alarm will be sent to the remote transceiver and the door will not be opened. In an alternative embodiment, the base transceiver sends out a continuous signal whereby the remote transceiver will receive a signal regarding the level of CO within the home whenever it comes within signal range of the base transceiver. In another alternative embodiment, each of the transceivers utilize cell phone technology to provide an alert at extended ranges.

Therefore, it is an objective of this invention to provide a Carbon Monoxide Safety System.

It is another objective of the instant invention to provide a Carbon Monoxide Safety System that includes a base transceiver in communication with a remote transceiver.

It is a further objective of the instant invention to provide a Carbon Monoxide Safety System wherein the remote transceiver communicates with the base transceiver to provide a warning of toxic gas levels within a dwelling prior to entry thereto.

It is yet another objective of the instant invention to provide a Carbon Monoxide Safety System wherein the base transceiver cooperates with a garage door opener for restricting garage door opening based on toxic gas levels within a dwelling.

It is still yet another objective of the instant invention to provide a Carbon Monoxide Safety System wherein the remote transceiver is constructed to send signals to the base transceiver for opening a garage door, as well as receive signals from the base transceiver regarding toxic gas levels within a dwelling.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE FIGURES

While the novel features of the invention are set forth with particularity in the appended claims, the invention, both as to organization and content, will be better understood and appreciated from the following detailed description, taken in conjunction with the drawings, in which:

DETAILED DESCRIPTION OF THE INVENTION

Figure 1:
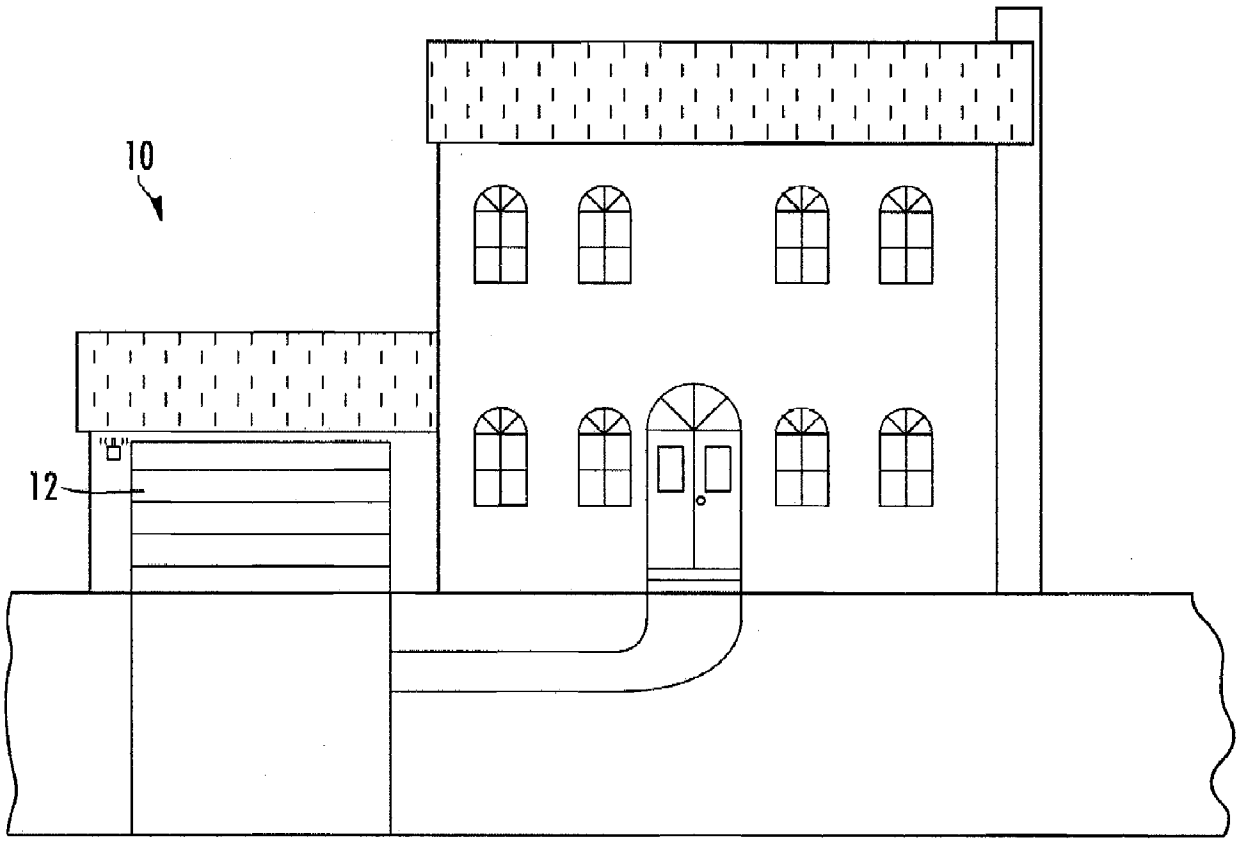
FIG. 1 is a front view, illustrating a dwelling utilizing one embodiment of the instant invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
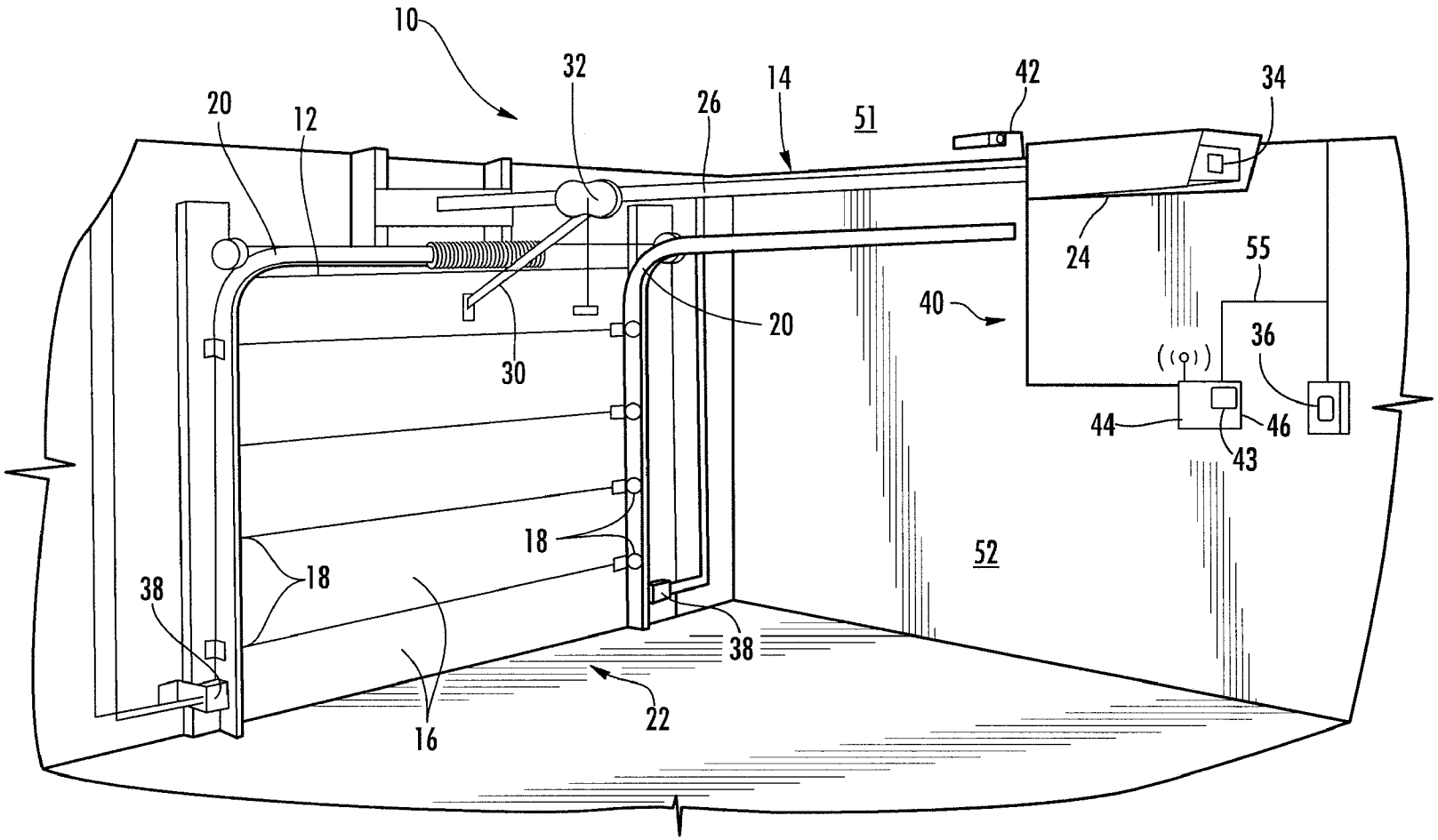
FIG. 2 is a partial perspective view of the dwelling shown in FIG. 1, illustrated from within the garage with the garage door in a closed position.

Referring more particularly to the drawings wherein is shown illustrative embodiments of the instant invention, FIG. 1 illustrates a typical dwelling having a garage door assembly, indicated generally at 10, including a garage door 12. FIG. 2 illustrates the interior of the garage portion of the dwelling. The garage door assembly 10 includes a garage door opening mechanism 14. The garage door 12 has a plurality of door panel segments 16, each panel segment having one or more pairs of vertically spaced sets of rollers 18 that are guided in a pair of generally parallel tracks 20. The tracks 20 are mounted adjacent an opening 22 and guide the garage door 12 between a shut position and an open position for entry of a vehicle into and from the garage. The garage door opening mechanism 14 includes a reversible electric motor 24 which drives a garage door opening device 26 such as an elongated screw or a gear that moves a chain to open and shut the garage door 12. A bracket 30 is secured to the garage door 12 and is operationally connected to the opening device 26 by a follower 32.

The garage door opening mechanism 14 includes a receiver 34 that is mounted adjacent and operatively connected to the reversible electric motor 24. The receiver 34 is connected to a wall switch 36 configured to actuate the motor. Located adjacent the lower ends of the tracks 20 are a pair of photo-eye sensors 38 mounted to project a beam of light across the garage door opening which, when interrupted by an object as the garage door 12 is closing, will reverse movement of the door to its open position. The illustrated garage door assembly 10 described hereto is of conventional design and well known to those in the art, and is provided for illustrative purposes to aid in describing the invention. One skilled in the art will appreciate that the invention may be used with other garage door assemblies without departing from the scope of the invention.

According to the invention, the garage door assembly 10 further includes a toxic gas safety system 40 including a base module 44 that interfaces with the garage door opening mechanism 14. The toxic gas safety system 40 comprises a base module 44 including a carbon monoxide (CO) detector 42 and a first transceiver 43. The base module 44 is configured to generate an actuating signal to cause the garage door opening mechanism 14 to open the garage door 12 upon receiving a signal from a remote module 50. The remote module may be carried in a vehicle or on a person to provide a signal to the base module 44 to open or close the garage door.

As described herein, the CO detector 42 is a carbon monoxide detector, but it is understood that the invention can also be used with sensors of other noxious or toxic gases without departing from the scope of the invention. Additionally, the invention is described as being used in a residential garage, but it is understood that the invention can beneficially be used in other spaces, such as auto repair facilities, workshops, furnace rooms, and the like where there is a danger of accumulating high levels of carbon monoxide or other gases without departing from the scope of the invention.

The CO detector 42 utilized in the illustrated embodiment can be of conventional design. As the operation of CO detectors are well known, a detailed description of the CO detector 42 need not be provided herein. One skilled in the art will recognize that the CO detector 42 used in the base module 44 can be any available CO detector, such as, for example, carbon monoxide detector model number FCD2 marketed under the First Alert® brand name and available from BRK Brands, Inc. of Aurora, Ill. The CO detector 42 may be a mechanically separate unit that is plugged into the base module 44 so that the CO detector receives its electrical power from the base module. Alternatively, the CO detector 42 can be mounted remote from the base module 44 in electrical communication therewith and can receive its power through an independent electrical cord (not shown), or the CO detector can be battery operated, without departing from the scope of the invention. In yet another embodiment, the CO detector 42 can be made integral with base module 44 so that the monitoring mechanism and CO detector have a common casing and are purchased and installed as a single unit. The CO detector 42 is preferably calibrated relatively low (200-400 ppm) so as to detect the presence of low levels of carbon monoxide. Alternately, the CO detector 42 can be calibrated with a time sensitive threshold. For example, the detector 42 can be calibrated to respond when the concentration of carbon monoxide in the air is 50 ppm for six hours, 200 ppm for one-half hour or 400 ppm at any time. However, these specific calibration limits are for example purposes only, and not intended to be limiting.

Figure 3:
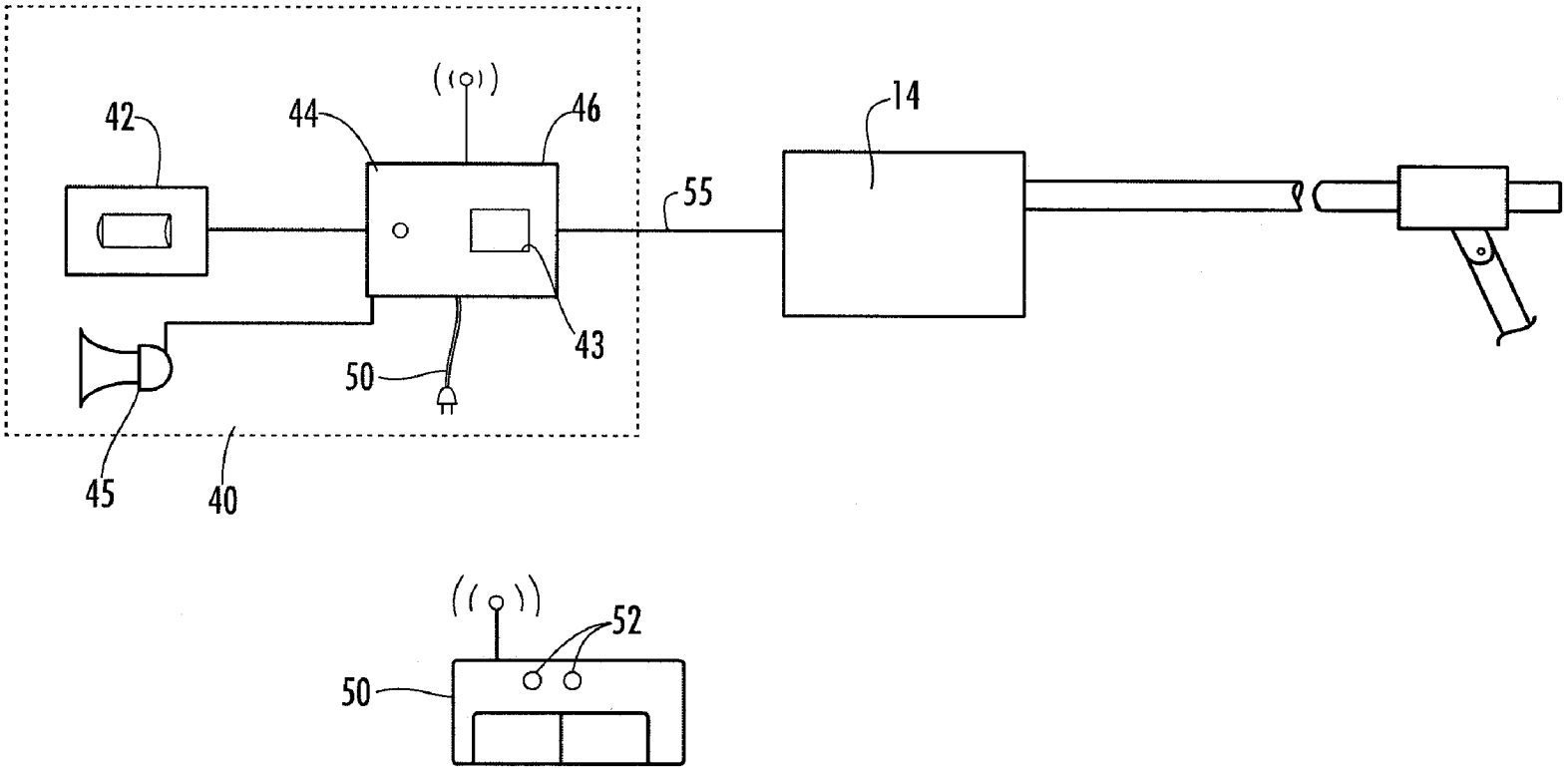
FIG. 3 is a front view illustrative of the instant invention.

As best seen in the embodiment depicted in FIGS. 2 and 3, the base module 44 includes a casing 46 that houses the first transceiver 43 and optionally the CO detector 42. A siren horn 45 may also be included within the housing or may be configured for remote connection. The base module 44 includes an electrical plug 50 extending from the casing 46 which may include an electrical connector suitable for connection to the electrical wiring of a conventional AC power supply grid that is commonly used in a dwelling, i.e., a wall outlet supplying 120 volts AC. Desirably, the CO detector 42 is attached to the ceiling 51 of the garage near the garage door opening mechanism 14 and plugs into the electrical outlet provided for the garage door opening mechanism 14. One or more mounting screws (not shown) pass through eyelets in the base module casing 46 to attach the casing to the garage ceiling 51 or wall 52. The base module is preferably hard wired to the CO detector for electrical connection therebetween.

When installed, it is desirable that the toxic gas safety system 40 be placed in proximity to the garage door opening mechanism 14. Signal wires 55 from the base module 44 are connected to the garage door opening mechanism 14.

In a first mode of operation, for use when the dwelling is occupied, the CO detector 42 senses the presence of carbon monoxide such as is well known in the art. In the event the carbon monoxide concentration reaches an unsafe level, the CO detector 42 will sound an audible alarm to alert the occupant(s) of the unsafe condition.

In a second mode of operation, such as when the occupant(s) are away from the home, the remote module 50 can be used to close the door of the garage in a typical fashion. In the preferred embodiment, the remote module and the base module communicate bi-directionally via radio frequency (RF). Alternatively, the remote module and base module may complete the bi-directional communication using infra-red (IR), laser, cell technology or any suitable combination thereof without departing from the scope of the invention. The base module continues to monitor CO while the occupant(s) are away. When the occupant(s) are within range of the base module or when an attempt to open the garage door is made, the base module sends an "OK to enter" signal to the remote module prior to sending a signal to the door opener 14 to open the door. Should the CO level within the dwelling be above the pre-determined threshold, the base module will send an alarm to the remote module and will not send a signal to the door opener to open the garage door for entry. In this manner, the occupants or others are not allowed to enter the dwelling without warning of a dangerous condition within the dwelling.

As an additional safety feature, the remote module of the instant invention may also contain a CO or other toxic gas detector such as those described for use with the base module. In addition, the remote module should contain at least one indicator light 52 and an alarm to alert the user of a safe or unsafe condition within the vehicle or in proximity to the person. The remote module may also be constructed and arranged to open multiple garage doors and or security gates as is well known in the art.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A Toxic Gas Safety System for warning an individual of a toxic gas level within a dwelling comprising:

a base module constructed and arranged for measuring the level of a toxic gas within a dwelling, said base module being constructed and arranged to include a first transceiver for electronically communicating said measured toxic gas level to a remote module, said remote module including a second transceiver for sending electronic communication to and receiving electronic communication from said base module, said remote module constructed and arranged to indicate a measured level of said toxic gas within said dwelling to a user prior to entry into said dwelling said remote module being constructed and arranged for remote control operation of said garage door, whereby upon sending an electronic communication to said base module to open said garage door an electronic communication is returned from said base module to said remote module indicating said measured level of toxic gas within said dwelling.

2. The Toxic Gas Safety System of claim 1 wherein said base module is in electrical communication with an electric garage door opener for controlled opening and closing of a garage door.

3. The Toxic Gas Safety System of claim 2 wherein said base module is constructed and arranged to prevent opening of said garage door when said toxic gas levels are above a predetermined threshold.

4. The Toxic Gas Safety System of claim 1 wherein said toxic gas is carbon monoxide.

5. A method of preventing entry into a dwelling containing a predetermined threshold of toxic gas therein comprising:

securing a base module within said dwelling, said base module being constructed and arranged for measuring the level of a toxic gas within said dwelling, said base module including a first transceiver for electronically communicating said measured toxic gas level to a remote module, said base module is in electrical communication with an electric garage door opener for controlled opening and closing of a garage door;

carrying said remote module in a vehicle, said remote module including a second transceiver for sending electronic communication to and receiving electronic communication from said base module;

sending an electronic communication from said remote module to said base module requesting said base module to open said garage door;

sending an electronic communication from said base module to said remote module indicating the measured level of said toxic gas within said dwelling;

sending an electrical signal from said base module to said garage door opener to open said garage door if said measured toxic gas levels are below a predetermined threshold;

sending an electrical signal from said base module to said garage door opener to prevent opening of said garage door if said measured toxic gas levels are above said predetermined threshold.

6. The method of preventing entry into a dwelling containing a predetermined threshold of toxic gas of claim 5 wherein said toxic gas is carbon monoxide.

7. A Toxic Gas Safety System for warning an individual of a toxic gas level within a dwelling comprising:

a base module constructed and arranged for measuring the level of a toxic gas within a dwelling, said base module being constructed and arranged to include a first transceiver for electronically communicating said measured toxic gas level to a remote module, said remote module including a second transceiver for sending electronic communication to and receiving electronic communication from said base module, said remote module constructed and arranged to indicate a measured level of said toxic gas within said dwelling to a user prior to entry into said dwelling said remote module being constructed and arranged for measuring the level of a toxic gas within a vehicle, wherein said remote module is constructed and arranged to indicate a measured level of said toxic gas within said vehicle to said user.

* * * * *